United States Patent [19]

Umezawa et al.

[11] Patent Number: 4,972,881

[45] Date of Patent: Nov. 27, 1990

[54] TACK-IN SELVAGE FORMING APPARATUS

[75] Inventors: Hidetsugu Umezawa, Tokyo; Yoshio Nitta, Tokorozawa; Tetsuji Watanabe; Takao Takahashi, both of Tokyo, all of Japan

[73] Assignee: Nissan Motor Co., Ltd., Yokohama, Japan

[21] Appl. No.: 381,082

[22] Filed: Jul. 18, 1989

[30] Foreign Application Priority Data

| | | | |
|---|---|---|---|
| Jul. 20, 1988 | [JP] | Japan | 63-178948 |
| Aug. 29, 1988 | [JP] | Japan | 63-112120 |
| May 2, 1989 | [JP] | Japan | 1-112002 |
| Jun. 26, 1989 | [JP] | Japan | 1-162876 |

[51] Int. Cl.[5] ..... D03D 47/48

[52] U.S. Cl. ..... 139/434

[58] Field of Search ..... 139/1 B, 54, 434, 433

[56] References Cited

U.S. PATENT DOCUMENTS

| | | | |
|---|---|---|---|
| 4,076,049 | 2/1978 | Manea | 139/434 |
| 4,600,039 | 7/1986 | Corain | 139/434 |
| 4,848,415 | 7/1989 | Manea | 139/434 |

FOREIGN PATENT DOCUMENTS

| | | |
|---|---|---|
| 59-130349 | 7/1984 | Japan . |
| 62-53448 | 3/1987 | Japan . |

*Primary Examiner*—Andrew M. Falik

*Attorney, Agent, or Firm*—Foley, Lardner, Schwartz, Jeffery, Schwaab, Mack, Blumenthal & Evans

[57] ABSTRACT

A tack-in selvage forming apparatus for tacking in the end portion of a picked weft yarn to form a selvage structure in weaving a towel. The tack-in selvage forming apapratus is comprised of a tack-in needle which is controllably driven by a driving mechanism including a cylindrical grooved cam rotatable in timed relation to a main shaft of a loom. The grooved cam is formed at its periphery with generally annular shallow and deep cam grooves. The shallow cam groove is parallel with a plane perpendicular to the axis of the grooved cam, while the deep cam groove is curved relative to the same plane. A part of the shallow cam groove and a part of the deep cam groove is common and the same in depth. The shallow cam groove has a profile corresponding to a resting state of the tack-in needle, while the deep cam groove has a profile corresponding to a tack-in operational state of the tack-in needle. A cam follower drivingly connected to the tack-in needle is selectively put into the shallow and deep cam grooves. Thus, the tack-in needle is rested when the cam follower is in the shallow cam groove and operated to accomplish tack-in of a weft yarn end portion when the cam follower is in the deep cam groove.

12 Claims, 19 Drawing Sheets

TACK-IN SELVAGE FORMING APPARATUS

BACKGROUND OF THE INVENTION

1. Field of the Invention

This invention relates to improvements in a tack-in selvage forming apparatus for a loom, and more particularly to a device for controllably driving a tack-in needle by which the end portion of a picked weft yarn is tacked in and woven in a fabric.

2. Description of the Prior Art

A variety of tack-in selvage forming apparatus have been proposed and arranged fundamentally as follows: A tack-in needle is attached to a needle shaft which is connected through a power transmission mechanism with a drive cam. The tack-in needle makes its forward and rearward movement in the direction of extension of warp yarns at predetermined timings and makes its reciprocal rotational movement around the axis of the needle shaft at predetermined timings under rotation of the drive cam, thereby catching the weft yarn end portion extending between a selvage structure and a weft yarn end portion retaining device and turning it up into a warp yarn shed opening.

In order to carry out a tack-in operation in weaving a pile structure of towel or the like, the advancing position of a reed is different between a fast beating-up operation and a blind beating-up operation, and therefore the tack-in selvage forming apparatus is required to be moved to accomplish a tack-in operation in each weaving cycle. This makes a high-speed operation of the loom difficult. In view of this, in practice, the tack-in selvage forming apparatus is arranged to be not moved, in which the tack-in needle is driven to take the weft yarn end portions at one time in a plurality of weaving cycles, thereby to tack in a plurality of the weft yarn end portion, at one time. Thus, the tack-in needle is arranged to rest in operation. Such an arrangement is disclosed, for example, in U.S. Pat. No. 4,600,039 entitled "Process and Device for the Formation of a Tucked Selvage, Especially Suitable for Terry Looms".

In the above-discussed arrangement, the needle shaft provided with the tack-in needle is driven through a cam follower which is biased on the drive cam by a spring. Additionally, the cam follower is withdrawn from the drive cam to rest the tack-in needle under the action of another cam. Thus, two different cams are required for driving and resting the tack-in needle. Additionally, since the spring is used to bias the cam follower onto the drive cam, it is impossible to operate the loom at a high speed.

SUMMARY OF THE INVENTION

It is an object of the present invention to provide an improved tack-in selvage forming apparatus in the operation (including driving and resting) of a tack-in needle can be achieved with a single drive cam and which makes possible a high-speed operation of the loom.

A tack-in selvage forming apparatus for a loom of the present invention is comprised of a tack-in needle which takes first and second operating states. A cylindrical grooved cam is provided to be rotatable in timed relation to a main shaft of the loom. The grooved cam has first and second cam grooves formed along the periphery of the grooved cam. The first cam groove is parallel with a plane perpendicular to the axis of said grooved cam. The second cam groove is curved relative to the plane. At least a part of the second cam groove is deeper than the first cam groove. A part of the first cam groove and a part of the second cam groove are common. The first cam groove has a profile corresponding to the first operating state of the tack-in needle, while the second cam groove has a profile corresponding to the second operating state of the tack-in needle. A cam follower is provided to selectively put the cam follower into the first and second cam grooves. A change-over mechanism is provided to selectively put the cam follower into the first and second cam grooves. The tack-in needle is put into the first and second operating states when the cam follower is put in the first and second cam grooves, respectively.

Accordingly, when the cam follower is put into and guided by the first (narrower) cam groove, the tack-in needle can be rested in tack-in operation. When the cam follower is put into and guided by the second (deeper) cam groove, the tack-in needle can make its reciprocal rotational movement, thereby accomplishing the tack-in operation of the end portion of a picked weft yarn. Thus, according to the present invention, the driving operation and the resting operation for the tack-needle can be accomplished by the single drive or grooved cam, and the tack-in selvage forming apparatus is sufficient in high-speed followability, thereby allowing high-speed operation of the loom.

BRIEF DESCRIPTION OF THE DRAWINGS

In the drawings, the same reference numerals designate the corresponding parts and elements throughout all the figures, in which.

DETAILED DESCRIPTION OF THE INVENTION

Figure 1:
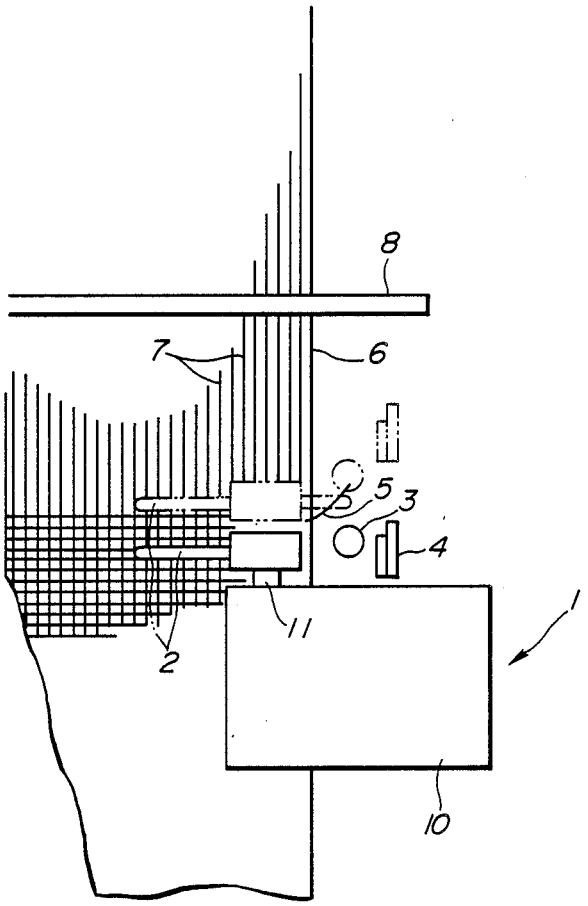
FIG. 1 is a schematic plan view of the vicinity of a first embodiment of a tack-in selvage forming apparatus according to the present invention.
Figure 2:
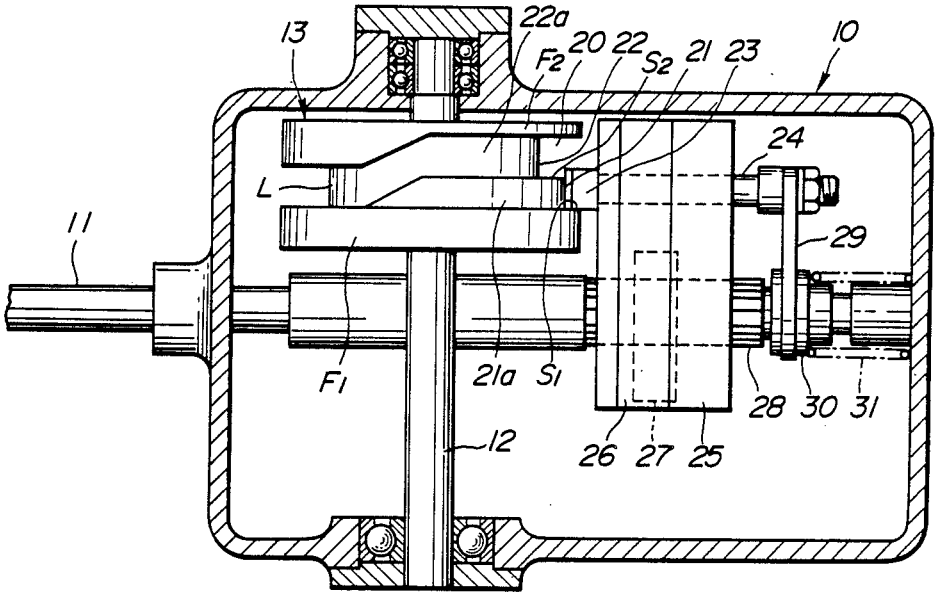
FIG. 2 is a fragmentary plan view of a main body of the tack-in selvage forming apparatus of FIG. 1.
Figure 3:
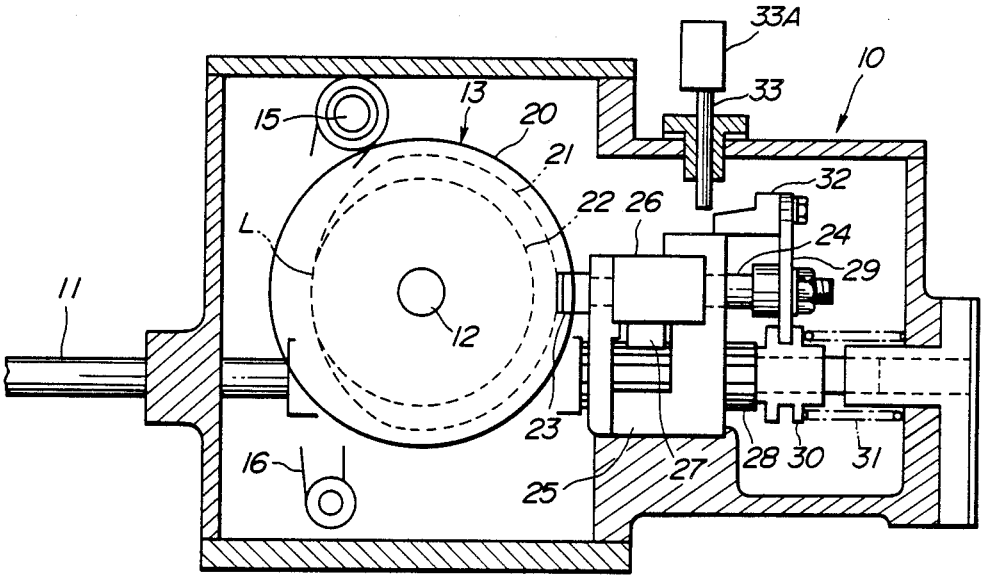
FIG. 3 is a fragmentary front view of the main body of FIG. 2.

Referring now to FIGS. 1 to 3 of the drawings, there is shown a first embodiment of a tack-in selvage forming apparatus 1 in accordance with the present invention. The tack-in selvage forming apparatus 1 of this embodiment is for a shuttleless loom such as an air jet loom. Referring particularly to FIG. 1, the tack-in selvage forming apparatus 1 comprises a tack-in needle 2 for accomplishing tack-in operation of the end portion 5 of a picked weft yarn. A weft yarn end retaining device 3 and a cutter 4 are provided near the tack-in needle 2. The tack-in needle per se and its operation are known as disclosed, for example, in U.S. Pat. No. 4,600,039 entitled "Process and Device for the Formation of a Tucked Selvage, Especially Suitable for Terry Looms". Operation of the tack-in selvage forming apparatus 1 is summarized as follows: The weft yarn beaten up by a reed 8 is cut by the cutter 4 thereby to obtain a predetermined weft picking length. This beating-up operation is during a pile formation in case of weaving a pile structure of a fabric. Simultaneously with the cutting operation, the end portion 5 of the cut weft yarn is retained by the weft yarn end retaining device 3 and a formed selvage 6 and is caught by the tack-in needle 2 to be turned up and pulled into the next shed opening of warp yarns 7.

The tack-in needle 2 is installed to an end section (on the side of the reed 8) of a needle shaft 11 which movably extends from a main body 10 of the tack-in selvage forming apparatus 1. Under driving action of this main body 10, the forward and rearward movement or axial movement of the needle shaft 11 causes the tack-in needle 2 to move in the forward and rearward or in the direction of extension of the warp yarns 7; and the reciprocal rotation..al movement of the needle shaft 11 around its axis causes the tack-in needle 2 to make its reciprocal rotational movement in the direction of extension of the weft yarn 5.

Referring to FIGS. 2 and 3, the main body 10 includes a driving mechanism (no numeral) for controllably driving the tack-in needle 2 through the needle shaft 11. The needle shaft 11 extends into a casing (no numeral) of the main body 10 and is rotatably supported in the casing. The needle shaft 11 extends in the fore-and-aft direction of the loom or in the direction of extension of the warp yarns 7. The driving mechanism for the needle shaft 11 includes a first driving mechanism (no numeral) for driving the needle shaft 11 in the fore-and-aft direction of the loom and a second driving mechanism (no numeral) for driving the needle shaft 11 to rotate around its axis.

The first driving mechanism includes a lever 16 which is pivotally fixed by a pivot pin 15 and swingable around the pivot 15. The lever 16 is provided at its longitudinal intermediate part with a cam follower (not shOWn) which is guided by a cam groove (not shown) formed on the side surface of a drive cam 13. The drive cam 13 is fixedly mounted on a drive shaft 12 which is rotated in timed relation to a main shaft (not shown) of the loom. The swinging movement of the lever 16 is transmitted through a joint (not shown) to the needle shaft 11, thus moving the needle shaft 11 in the fore-and-aft direction.

The second driving mechanism includes the drive cam 13 which is formed along its periphery with a cylindrical grooved cam 20. In the cylindrical grooved cam 20, a shallow cam groove 21 and a deep cam groove 22 are formed side by side. The shallow groove 21 has a profile for resting the take-in operation of the tack-in needle 2, while the deep groove 22 has a profile for driving the tack-in needle 2 to make its tack-in operation. More specifically, the shallow groove 21 is defined by a cam face **21*a* and has a profile for resting the tack-in operation of the tack-in needle 2, while the deep groove 22 is defined by another cam face 22*a* and has a profile for accomplishing the tack-in operation of the tack-in needle 2. It is to be noted that the two cam faces 21*a*, 22*a* are commonly used at a location L. The cam face 21*a* is formed cylindrical and along the whole periphery of the cylindrical grooved cam 20, so that the cam face 21*a* does not displace in the axial direction of the cylindrical grooved cam 20. The cam face 22*a* is formed curved along the whole periphery of the cylindrical grooved cam 20 in such a manner that the cam face 29 displaces in the axial direction of the cylindrical grooved cam 20 within a range corresponding to the reciprocal rotational movement of the tack-in needle 2 around the axis of the needle shaft 11. It will be understood that the commonly used cam faces 21*a*, 22*a* define a shallow groove which is the same as the shallow groove 21. The shallow groove 21 is defined further by the annular side wall surface $S_1$ of a flange-like section $F_1$ of the cylindrical grooved cam 20. The flange-like section $F_1$ extends radially outwardly. Additionally, the deep groove 22 is defined further by a radially outwardly projecting section defining the cam face 21*a* and the anuular side wall surface $S_2$ of a flange-like section $F_2$ formed opposite to the flange-like section $F_1$.A cam follower 23 is selectively brought into engagement with and guided by the shallow and deep grooves 21, 22**.

A power transmission mechanism (no numeral) is provided to convert the movement of the cam follower 23 to the reciprocal rotational movement of the tack-in needle 2. The power transmission mechanism includes a slider 26 which is guided by a guide rail 25. A shaft 24 supports the cam follower 23 -t its tip end and slidably disposed passing through the slider 26. A rack gear 27 is fixedly secured to the slider 26 and extends in the sliding direction of the slider 26. The rack gear 27 is in engagement with a pinion gear 28 which is fixedly mounted on the needle shaft 11 at the intermediate part. The slider 26 is biased downward in FIG. 2 by a spring (not shown) so that the cam follower 23 is brought into contact with the side surface 21*a* of the shallow groove 21. A bracket 29 is fixedly secured to the end section of the shaft 24 for the cam follower 23 and is further secured to a bushing 30 slidably mounted on the needle shaft 11. The bushing 30 is movable along the needle shaft 11 between the end face of the pinion gear 28 and the end face of a bearing 10*b* supported by the casing 10*a*. The bushing 30 is biased in the direction to be pressed against the end face of the pinion gear under the action of a spring 31.

A change-over mechanism (no numeral) is provided to selectively bring the cam follower 23 into engagement with the shallow groove (having a profile for resting the tack-in operation) 21 and the deep groove (having a profile for accomplish the tack-in operation) 22. More specifically, a piece 32 is fixedly secured to the bracket 29. A stopper 33 is provided to be contactable with and releasable from the piece 32. Accordingly, the piece 32 is brought into contact with the stopper 33 when the stopper 33 is moved toward the side of the piece 32, while it is not brought into contact with the stopper 33 when the stopper 33 is moved toward the side of the piece 32. Such movement of the stopper 33 toward and far from the piece 32 is accomplished under the action of an actuator 33A of the electromagnetically operated type.

The manner of operation of the thus arranged tack-in selvage forming apparatus 1 will be discussed hereinafter.

The drive shaft 12 makes its one rotation in every rotation of the loom main shaft, i.e., in every weaving cycle. In such a weaving cycle, before a rotational angle of the loom main shaft reaches a value of initiation of the reciprocal rotational movement of the tack-in needle 2, the cam follower 23 gets out of the cylindrical grooved cam 20 through the bushing 30, the bracket 29 and the shaft 24 under the backward (rightward in FIG. 2 and 3) movement of the needle shaft 11 and is brought into a position corresponding to the shallow groove 21. Since the slider 26 is biased by the spring, the cam follower 23 is brought into contact with the side surface $S_1$ of the shallow groove 21. At this time, the actuator 33A is deenergized by a control unit (not shown), and accordingly the stopper 33 moves toward the side of the piece 32 and is put into its engagement position with the piece 32. As a result, even when the needle shaft 11 moves forward (leftward in FIGS. 2 and 3), the projecting amount of the cam follower 23 is limited and corresponds to the shallow groove 21, in which the cam follower 23 is brought into contact with the side surface $S_1$ of the shallow groove 21. Thus, the needle shaft 11 is axially moved forward and rearward under the action of the first driving mechanism; however, the cam follower 23 is restricted by the shallow groove 21, and therefore the tack-in needle makes only its fore-and-aft movement between its withdrawal position and its intermediate position. Consequently, the reciprocal rotational movement of the tack-in needle 2 around the needle shaft 11 is stopped so that no operation of taking the weft yarn is made.

When the actuator 33A is energized by the control unit, the stopper 33 moves away from the piece 32 and is put into its released position from the piece 32. Accordingly, when the needle shaft 11 moves forward, the shaft 24 moves forward together with the bushing 30 and the like biased by the spring 31, so that the cam follower 23 enters and is guided by the deep groove 22. In other words, the cam follower 23 is moved from the tack-in resting profile to the tack-in profile of the cylindrical grooved cam 20. As a result, the tack-in needle 2 is moved successively from its withdrawal position, intermediate position, weft yarn end portion catching position, intermediate position and withdrawal position under cooperation with the first and second driving mechanisms, and therefore causes the weft yarn end portion 5 to be extended between the weft yarn end retaining device 3 and the selvage structure 6 to be woven in the fabric.

Figure 4:
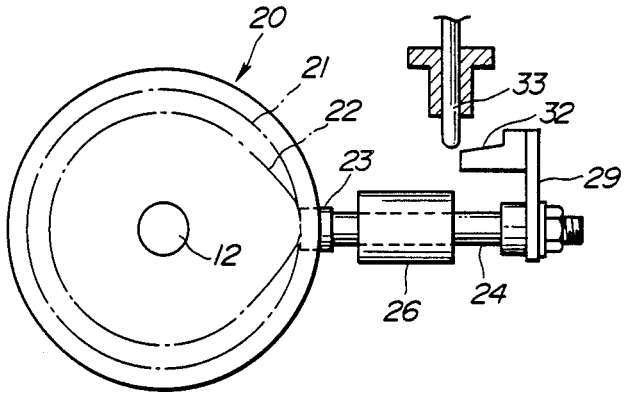
FIGS. 4 and 5 are fragmentary front views of essential parts of the main bodies of modified examples of the first embodiment tack-in selvage forming apparatuses.
Figure 5:
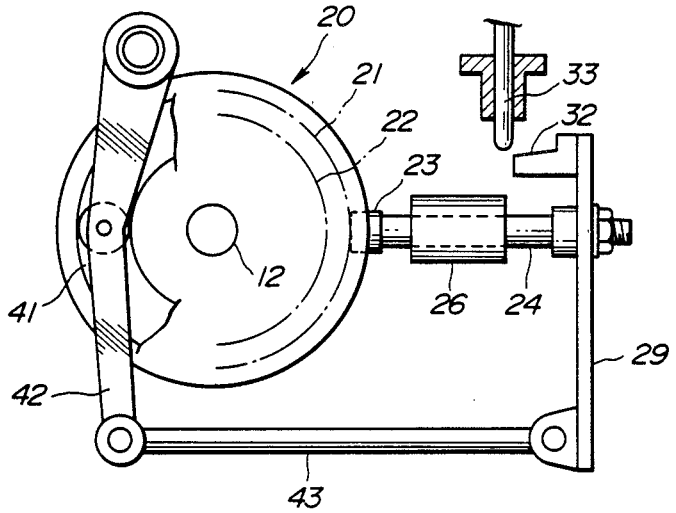

In the above-discussed arrangement, the cam follower 23 gets out of the deep groove 22 and enters the shallow groove 21 under the axial movement or fore-and-aft movement of the needle shaft 11, thereby accomplishing an automatic restoration of the cam follower 23. It will be understood that the automatic restoration may be accomplished by arrangements shown in FIGS. 4 and 5. In FIG. 4, the profile of the deep groove 22 is so formed that the cam follower 23 can be pushed out of the deep groove 22 to be brought into engagement with the shallow grooved 21. In FIG. 5, the cylindrical groove cam 20 is formed on its side surface with a cam groove 41 in which a cam follower of a pivotted lever 42 is engaged. The lever 42 is connected through a link 43 to the bracket 29. Accordingly, the cam follower 23 can be pulled out of the deep groove 22 to be brought into engagement with the shallow groove 21.

Figure 6:
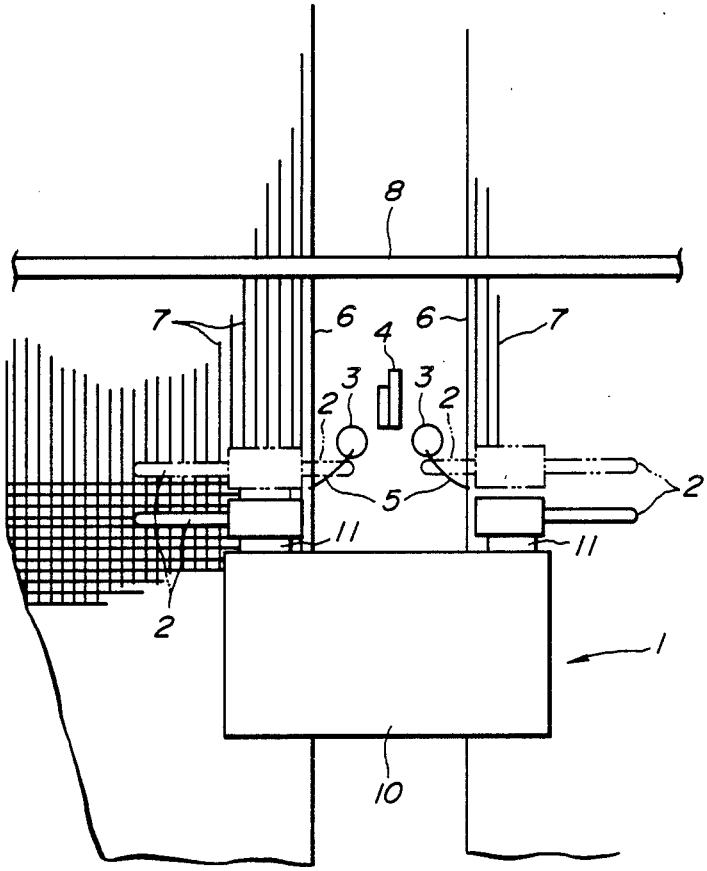
FIG. 6 is a schematic plan view of the vicinity of a second embodiment of the tack-in selvage forming apparatus according to the present invention.

FIGS. 6 to 10D illustrate a second embodiment of the tack-in selvage forming apparatus 1 in accordance with the present invention, which is similar to the first embodiment with the exception that the principle of the present invention is applied to the apparatus of the type providing with two tack-in needles 2, 2 and two needle shafts 11, 11. The tack-in selvage forming apparatus 1 of this embodiment is a so-called two-phase weaving loom in which two fabrics are parallely and simultaneously woven, so that the apparatus 1 is disposed to form two inside selvage structures 6, 6 of the two fabrics as shown in FIG. 6.

Figure 7:
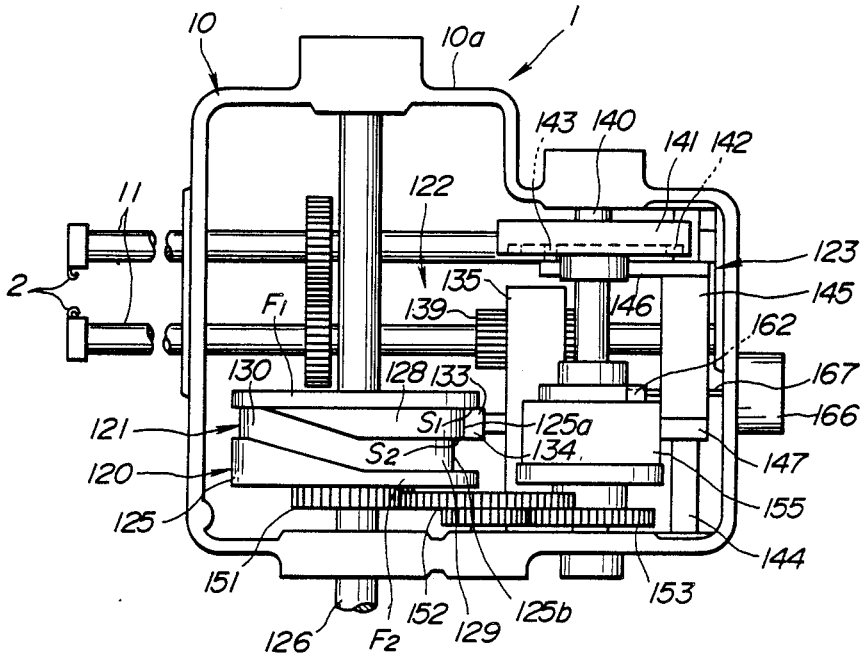
FIG. 7 is a fragmentary plan view of the main body of the tack-in selvage forming apparatus of FIG. 6.
Figure 8:
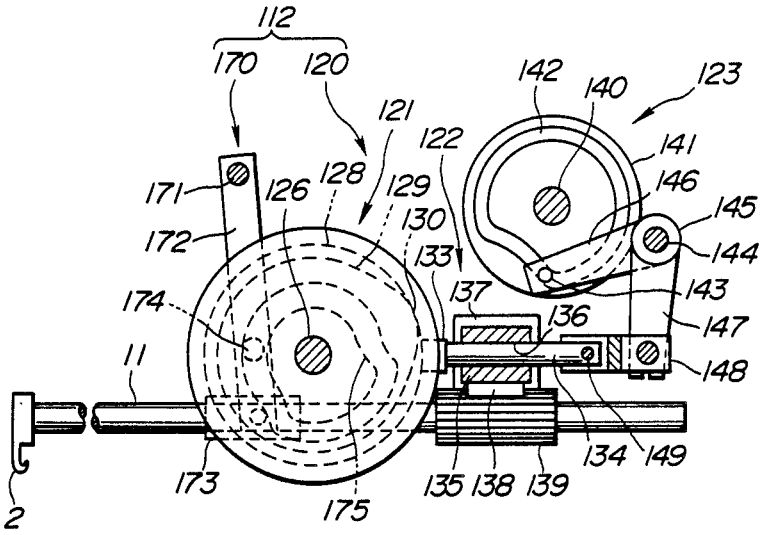
FIG. 8 is a fragmentary side view of an essential part of the main body of FIG. 7.
Figure 9:
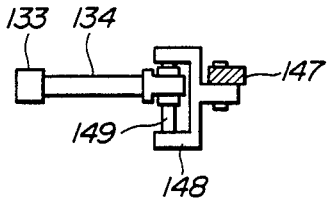
FIG. 9 is a plan view of an essential part of the main body of FIG. 7.

Referring to FIGS. 7 to 9, each tack-in needle 2 is installed to the tip end portion (on the side of the reed 8) of the needle shaft 11 of the main body 10 of the tack-in selvage forming apparatus 1. The tack-in needle 2 makes its reciprocal rotational movement of the needle shaft 11 around the axis of the needle shaft 11 under the reciprocal rotational movement of the needle shaft 11 around its axis, and makes its forward and rearward movement in the direction of extension of the warp yarns 7 under the axial movement of the needle shaft 11. Thus, the tack-in needle 2 moves from its withdrawal position (indicated in solid line) through an intermediate position (indicated by dot-dash line) at which the end portion of the weft yarn is caught by the tack-in needle 2 to be pulled into the shed opening of warp yarns 7.

A driving mechanics 112 for the needle shaft 11 includes a rotationally driving mechanism 120 for causing the reciprocal rotational movement of the needle shaft 11 and an axially driving mechanism 170 for causing the axial movement of the needle shaft 11. The rotationally driving mechanism 120 includes a disc-shaped drive cam 121 which is formed at the outer periphery with a cylindrical grooved cam 125. The drive cam 121 is coaxially fixedly mounted on a drive shaft 126 at the intermediate part. The drive shaft 126 is located separate from the needle shafts 11, 11 and extends in the direction crossing the needle shafts 11, 11 at right angles as shown in FIG. 7. The drive shaft 126 is rotatably supported by opposite side walls of the casing 10*a* and projects outward of the casing, in which the projecting part of the drive shaft 126 is drivably connected through a cogged pulley and a timing belt to another drive shaft which is rotatable in timed relation to the main shaft of the loom. The cylindrical grooved cam 125 has an annular narrow cam groove 125*a* and a annular deep cam groove 125*b* which are formed side by side. The deep groove 125*a* is defined by a annular cam face 128 and has a profile for resting the tack-in operation of the tack-in needle 2, while the shallow groove 125*a* is defined by another generally annular cam face 129 and has a profile for accomplishing the tack-in operation of the tack-in needle 2. It is to be noted that the two cam faces 128, 129 are commonly used at a location 130. The cam face 128 is formed cylindrical and along the whole periphery of the cylindrical grooved cam 125, so that the cam face 128 does not displace in the axial direction of the cylindrical grooved cam 125. The cam face 129 is formed curved along the whole periphery of the cylindrical grooved cam 125 in such a manner that the cam face 129 displaces in the axial direction of the cylindrical grooved cam 125 is within a range corresponding to the reciprocal rotational movement of the tack-in needle 2 around the axis of the needle shaft 11. It will be understood that the commonly used cam faces 128, 129 define a shallow groove which is the same as the shallow groove 125*a*. The shallow groove 125*a* is defined further by the annular side wall surface $S_1$ of a flange-like section $F_1$ of the cylindrical grooved cam 125. The flange-like section $F_1$ extends radially outwardly. Additionally, the deep groove 125*b* is defined further by a radially outward projecting section (no numeral) defining the cam face 28 and the annular side all surface $S_2$ of a flange-like section $F_2$ formed opposite to the flange-like section $F_1$.

A power transmission mechanism 122 is provided to convert the movement of a cam follower 133 by the tack-in cam face 129 into the reciprocal rotational movement of the tack-in needle 2. The cam follower 133 is attached to the tip end portion of a shaft 134 which is slidably disposed in a through-hole 136 formed in a slider 135, the through-hole 136 having a diameter which is similar to that of the shaft 134. The slider 135 is slidably engaged with a guide rail 137 which is fixedly secured to the main body 10 of the tack-in selvage forming apparatus 1. A rack gear 138 is fixedly secured to the slider 135 and engaged with a pinion gear 139 which is securely mounted on the needle shaft 11 at the intermediate part. The slider 135 is biased in the axial direction of the grooved cam 125 and in the upward direction in FIG. 7, so that the cam follower 133 is pressed against the side surface $S_1$ of the flange-like section $F_1$ or the side surface of the radially outreadly projecting section defining the tack-in cam face 125*a*. The rear end section of the shaft 134 is connected to a change-over mechanism 123.

The change-over mechanism 123 is provided to cause the cam follower 133 to be selectively brought into engagement with the tack-in resting cam face 128 and the tack-in cam face 129. The change-over mechanism 123 is of the type of a cam arrangement for compulsorily accomplishing the above selective operation of the cam follower 133. .The change-over mechanism 123 includes a change-over cam 141 fixedly mounted on a decelerated shaft 140 and formed at its side surface with a cam groove 142. A cam follower 143 is attached to the tip end portion of an arm 146 of a two-armed cylinder 145 which is rotatably mounted on a fixed shaft 144 extending in the rear end part of the main body 10. Another arm 147 of the two-armed cylinder 145 is rotatably provided at its tip end portion with a clevis 148 having a shaft 149 bridging the opposite rod portions of the U-shaped section. The rear end section of the shaft -34 of the power transmission mechanism 122 is mounted on the shaft 149 and slidably movable in the axial direction of the shaft 149 as shown in FIG. 9. Accordingly, upon rotation of the change-over cam 141, the cam follower 133 makes its forward and rearward movement in the radial direction to the drive cam 121. The decelerated shaft 140, on which the change-over cam 141 is rotatably supported by the drive shaft 126 through a drive gear 151, an intermediate gear 152 and a drive gear 153. The decelerated shaft 140 rotates 1/N time per one rotation of the drive shaft 126. For example, in case a beating-up operation for forming a pile is carried out one time during three weaving cycles under so-called terry-motion, the decelerated shaft 140 rotates ⅓ time per one rotation of the drive shaft 126.

Figure 10A:
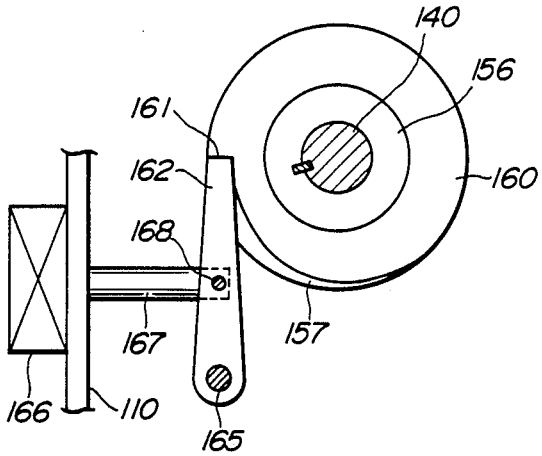
FIGS. 10A and 10B are fragmentary schematic illustrations showing a disengaging state of a clutch used in the main body of FIG. 7.
Figure 10B:
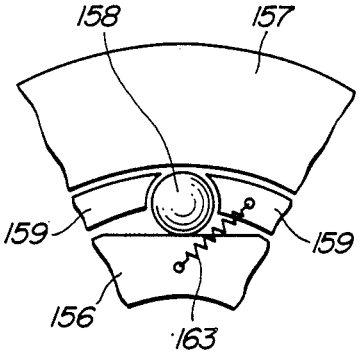
Figure 10C:
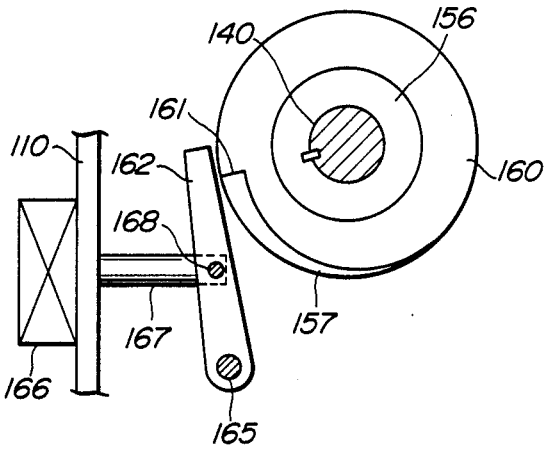
FIGS. 10C and 10D are fragmentary schematic illustrations similar FIGS. 10A and 10B but showing an engaging state of the clutch.
Figure 10D:
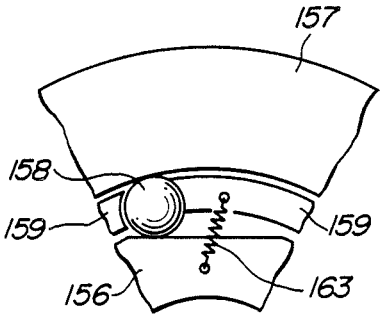

The driven gear 153 is rotatably mounted on the decelerated shaft 140 and so arranged as to rotate together with the decelerated shaft 40 as a single piece upon engagement of a clutch 155 and to singly freely rotate upon disengagement of the clutch 155. The clutch 155 is known per se and is a so-called SR clutch (produced by a Tsubakimoto Emerson Co., Ltd. in Japan) in this embodiment. This clutch 155 will be discussed with reference to FIGS. 10A to 10D. The clutch 155 includes a polygonal inner ring 156 fitted on the decelerated shaft 140. An outer ring 157 is generally coaxially disposed around the inner ring 156 and fixed to the driven gear 153. Rollers 158 are interposed between the inner and outer rings 156, 157. A trip cage 159 is disposed to move the rollers 158 in the peripheral direction of inner and outer rings 156, 157. With this arrangement, when the free end of a lever 162 is brought into engagement with a stopper section 161 of a trip cam 160 which is connected to the trip cage 159 as shown in FIG. 10A, each roller 158 is pushed by the trip cage 159 and put into a freely movable state in a space between the inner and outer rings 156, 157, so that the driving connection between the inner and outer rings 156, 157 is interrupted to put the clutch 156 into a disenging state as shown in FIG. 10B. When the free end of the lever 162 is disengaged from the stopper section 161 of the trip cam 160 as shown in FIG. 10C, the trip cage 159 brings each roller 158 into a position at which the roller 158 is tightly engaged between the inner and outer rings 156, 157, so that the inner and outer rings 156, 157 are connected through the rollers 158 thereby putting the clutch 155 into an engaging state. The base end of the lever 162 is pivotally connected to the main body 10 through a fixed shaft 165. The intermediate part of the lever 162 is connected through a pin 168 with an armature 167 of an electromagnetically operated actuator 166. Accordingly, under the action of the actuator 166, the lever 162 is driven to selectively take its engaging position at which its free end section is engaged with the stopper section 161 of the trip cam 160 and its disengaging position at which its free end section is disengaged from the trip cam stopper section 161. The driving mechanism 112 further includes a lever 172 pivotally attached to the main body 10 through a pivot pin 171. The free end section of the lever 172 is connected to a bracket 173 which is mounted on the needle shaft 11 in such a manner as to be rotatable around the needle shaft 11 and to be prevented from its axial movement. A cam follower 174 is rotatably attached to the intermediate part of the needle shaft 11 and is engaged in a cam groove 175. Accordingly, the needle shaft 11 can be axially moved forward and rearward under rotation of the drive cam 121.

The manner of operation of the second embodiment tack-in selvage forming apparatus will be discussed separately for formation of a pile structure and for formation of a non-pile structure.

(1) In case of formation of a pile structure:

The drive shaft 126 makes its one rotation per one rotation of the main shaft of the loom, i.e., per one weaving cycle. The decelerated shaft 140 makes its one rotation per three rotations of the drive cam 121, i.e., the change-over cam 141 makes its one rotation per three rotations of the drive cam 121, because the decelerated shaft 140 rotates together with the driven gear 153 as a single body when the clutch 155 is engaged upon the rearward movement of the armature 167 of the electromagnetic actuator 166. The actuator 166 is operated by the controller (not shown). In other words, in the two rotations (corresponding to the weaving cycles of so-called blind beating-up operations) of the drive cam 121 in three times rotations of the loom main shaft, the cam follower 133 is moved rearward in the radially outward direction of the drive cam 121 under the action of the cam groove 142 of the change-over cam 141, so that the cam follower 133 is brought into engagement with the shallow groove 125*a* and slidingly contacts with the tack-in resting cam face 128. As a result, in the two weaving cycles of blind beating-up operation, although the needle shaft 11 is axially moved forward and rearward under the action of the axially driving mechanism 170, it is prevented from its reciprocal rotational movement upon sliding contact of the cam follower 133 with the tack-in resting cam face 128. Accordingly, the tack-in needle 2 makes only its fore-and-aft movement between the withdrawal position and the intermediate position and therefore is prevented from its reciprocal rotational movement around the axis of the needle shaft 11. Consequently the weft yarn end pulling operation of the tack-in needle 2 is not carried out.

In the one rotation (corresponding to the weaving cycle for a pile formation or fast beating-up operation) in the three rotations of the loom main shaft, the rotation of the drive cam 121 and the change-over cam 141 proceeds and then the cam follower 133 advances in the radially inward direction of the drive cam 121 so as to be disengaged from the tack-in resting cam face 28 and brought into engagement with the tack-in cam face 129 when the cam follower 133 is positioned at the, common location 130 of the two cam faces 128, 129, or when the rotational angle of the loom main shaft reaches a timing before initiation of the reciprocal rotational movement of the tack-in needle 2. As a result, under cooperation of the axially driving mechanism 170 and the rotationally driving mechanism 120, the tack-in needle 2 is successively moved in the order of the withdrawal position, the intermediate position, the weft catching section, the tack-in position and the withdrawal position, so that the weft yarn end portion 5 extended between the weft retaining device 3 and the selvage structure 6 is caught and turned up and then pulled into the next warp shed by the tack-in needle 2 so that the weft yarn end portion 5 is woven in the fabric. Here, the cam follower 133 is pressed against one side surface $S_2$ defining the deep groove 125*b* when the tack-in needle 2 is brought into the catching position to accomplish the weft yarn end catching operation upon engagement of the cam follower 133 with the take-in cam face 129. This prevents the tack-in needle 2 from its vibration, thereby avoiding failure in catching the weft yarn end portion by the tack-in needle 2.

(2) In case of formation of a non-pile structure:

In a condition where the cam follower 133 is in the common location 130 of the two cam faces 128, 129, the lever 162 is brought into engagement with the stopper section 161 upon the forward movement of the armature 167 of the solenoid actuator 166 under the action of the controller (not shown) and therefore the clutch 155 is disengaged. Then, the driven gear 153 is brought into a condition to be freely rotatable relative to decelerated shaft 140, so that the drive cam 121 is rotated under rotation of the drive shaft 126 while the decelerated shaft 140 is brought into its stopped state. In other words, in a condition the disengagement action of the clutch 155, the cam follower 133 is maintained advanced in the radially inward direction of the drive cam 121 and continues to engage with the tack-in cam face 129 under the action of the cam groove 142 of the change-over cam 141. As a result, in every rotation of the loom main shaft or in every weaving cycle, the tack-in needle 2 is moved in the order of the withdrawal position, the middle position, the weft yarn end portion catching position, and the tack-in position and the withdrawal position under cooperation of the axially driving mechanism 170 and the rotationally driving mechanism 120, thus catching, turning up and pulling the weft yarn end portion 5 extended between the weft yarn end retaining device 3 and the selvage structure 6.

According to the second embodiment, the selective operation of the tack-in needle 2 between a tack-in state and a resting state is compulsorily carried out by using a cam, and therefore the followability of the cam follower connected to the tack-in needle is improved, thereby making high speed operation of the loom possible.

Figure 11:
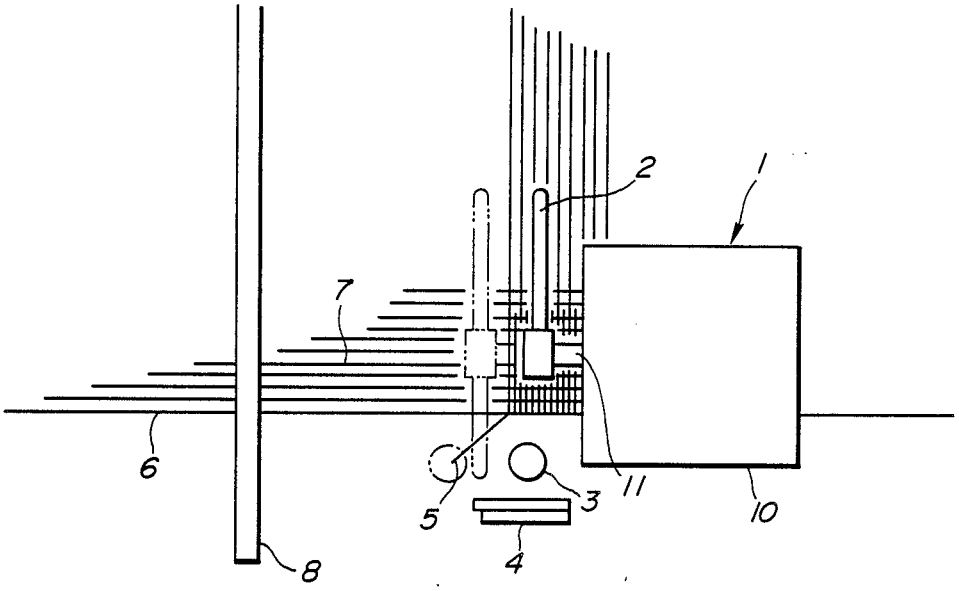
FIGS. 11 is a schematic plan view of the vicinity of a third embodiment of the tack-in selvage forming apparatus according to the present invention.

FIGS. 11 to 18 illustrate a third embodiment of the tack-in selvage forming apparatus 1 in accordance with the present invention, which is similar to the second embodiment. The tack-in selvage forming apparatus of this embodiment is arranged to form the selvage structure 6 on the left side edge of the fabric as shown in FIG. 11. In this embodiment, a tack-in operation is made for a plurality (three in this case) of weft yarn end portions 5 concurrently in order to weave a pile section of a towel, while a tack-in operation is made for each weft yarn end portion 5 in order to weave a border section of the towel. Accordingly, the tack-in needle 2 makes its fore-and-aft movement along the direction of extension of the warp yarns 7 per one rotation of the loom main shaft upon the axial fore-and-aft movement of the needle shaft 11. During this, the tack-in needle 2 makes its one reciprocal rotational movement around the axis of the needle shaft 11 per three rotations of the loom main shaft in order to weave the pile section, while the tack-in needle 2 makes the one reciprocal rotational movement per each rotation of the loom main shaft in order to weave the border section.

A driving mechanism for the needle shaft 11 of the main body 10 of the tack-in selvage forming apparatus 1 will be discussed, in which explanation is made only of a rotationally driving mechanism for accomplishing the reciprocal rotational movement of the needle shaft 11, omitting explanation of an axially driving mechanism for accomplishing the fore-and-aft movement of the needle shaft 11.

Figure 14:
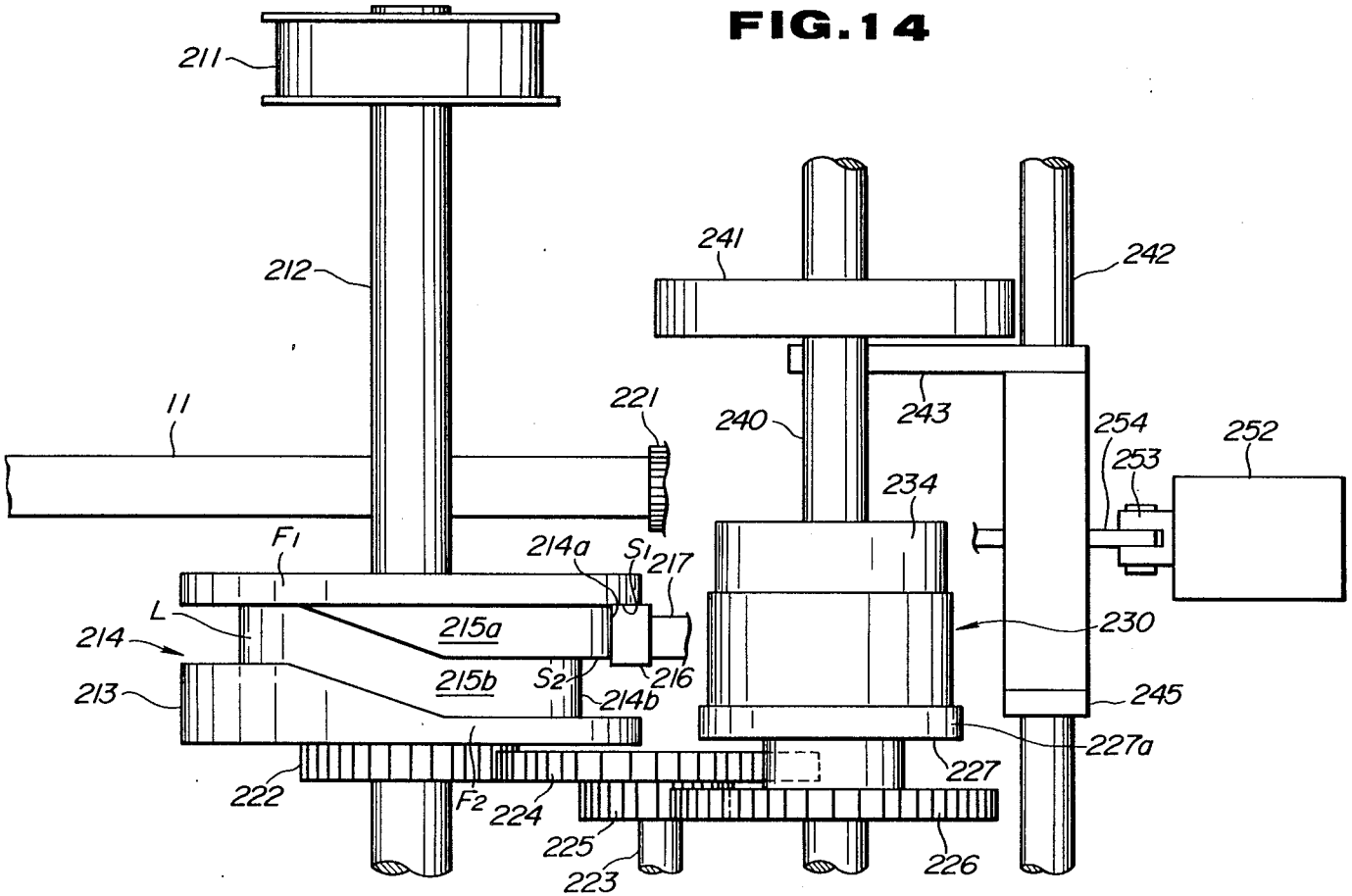
FIG. 14 is a fragmentary plan view of an essential part of the main body of FIG. 12.

Referring to FIG. 14, the driving mechanism includes a generally cylindrical drive cam 213 which is fixedly mounted on a drive shaft 212 which is rotated by the loom main shaft (not shown) through a power input sprocket 211 fixedly mounted on the drive shaft 212. The drive cam 213 is formed at the outer periphery with a cylindrical grooved cam 214. The cylindrical grooved cam 124 has an annular narrow cam groove 214*a* and an annular deep cam groove 214*b* which are formed side by side. The shallow groove 214*a* is defined by a cam face 215*a* and has a profile for resting the tack-in operation of the tack-in needle 2, while the deep groove 214*b* is defined by another cam face 215*b* and has a profile for accomplishing the tack-in operation of the tack-in needle 2. It is to be noted that the two cam faces 215*a*, 215*b* are commonly used at a location L. The cam face 215*a* is formed cylindrical and along the whole periphery of the cylindrical grooved cam 214, so that the cam face 215*a* does not displace in the axial direction of the cylindrical grooved cam 214. The cam face 215*b* is formed curved along the whole periphery of the cylindrical grooved cam 125 in such a manner that the cam face 215*b* displaces in the axial direction of the cylindrical grooved cam 214 is within a range corresponding to the reciprocal rotational movement of the tack-in needle 2 around the axis of the needle shaft 11. It will be understood that the commonly used parts of the cam faces 215*a*, 215*b* define a deep groove which is the same as the deep groove 215*b*. The shallow groove 125*a* is defined further by the annular side wall surface $S_1$ of a flange-like section $F_1$ of the cylindrical grooved cam 214. The flange-like section $F_1$ radially outwardly extends. Additionally, the deep groove 214*b* is defined further by a radially outward projecting section (no numeral) defining the cam face 215*a* and the annular side wall surface $S_2$ of a flange-like section $F_2$ formed opposite to the flange-like section $F_1$.

A cam follower 216 is selectively engaged in and guided by the shallow and deep grooves 214*a*, 214*b*. The cam follower 216 is pressed against the side wall surface $S_1$ of the shallow groove 214*a* and controllably changed in its position in the radial direction (lateral direction in FIG. 14) of the grooved cam 214. When the cam follower 216 is in the position corresponding to the shallow groove 214*a*, it is not moved in the axial direction of the drive cam 213 upon being guided by annular cam face 215*a* and being pressed against the side wall surface $S_1$. When the cam follower 216 is in the position corresponding to the deep groove 214*b*, it is moved in the axial direction of the drive cam 213 upon being guided by the curved cam face 215*b*.

Figure 15:
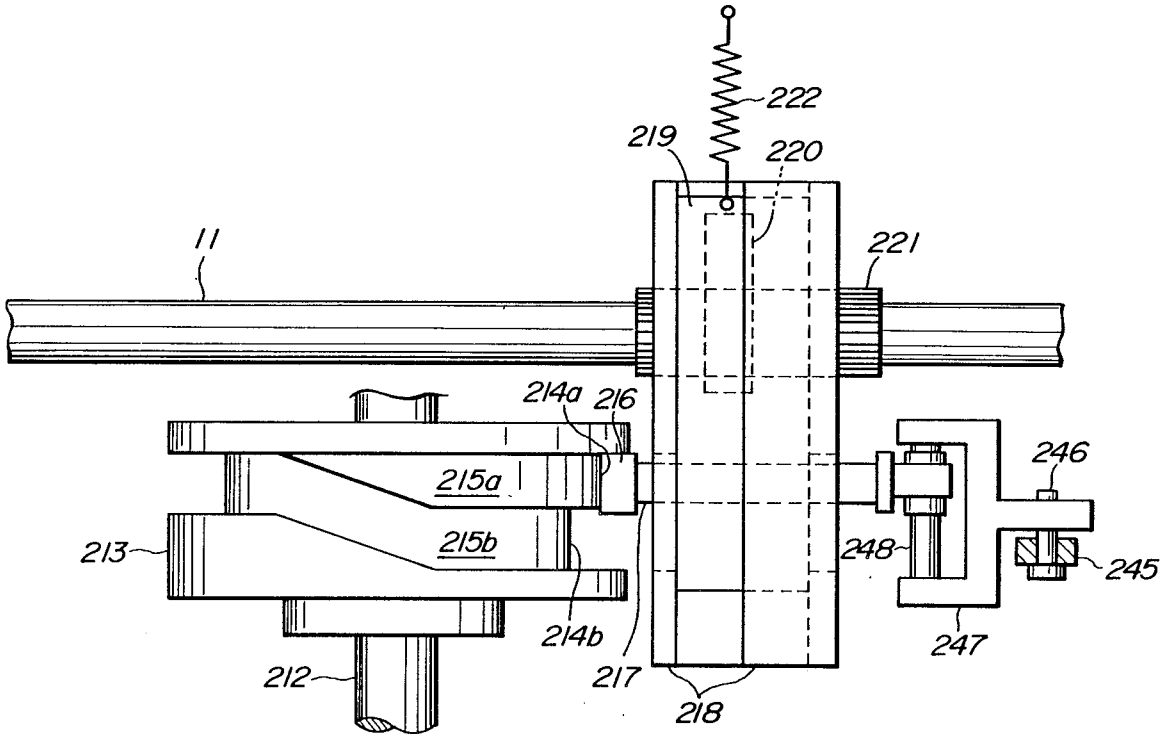
FIG. 15 is a fragmentary plan view similar to FIG. 14 but showing a part different from that of FIG. 14.
Figure 16:
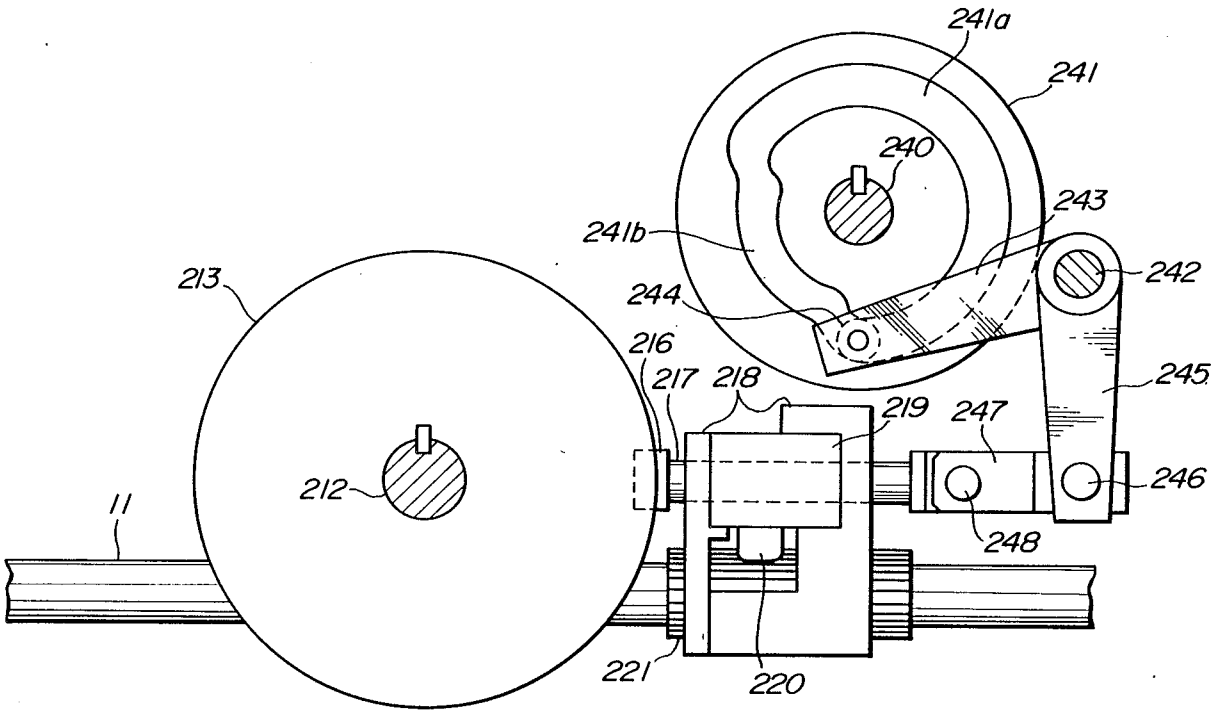
FIG. 16 is a fragmentary front view of an essential part of the main body of FIG. 12.

The lateral or axial movement of the cam follower 216 is converted into the reciprocal rotational movement of the needle shaft 11 by a power transmission mechanism (no numeral). More specifically, as shown in FIG. 15 and 16, the cam follower 216 is rotatably supported on a rod 217 which extends in the fore-and-aft direction of the loom. The rod 217 is slidably passed through a through-hole (not shown) of a slider 219, so that the lateral movement (in the axial direction) of the drive cam 213 is transmitted through the rod 217 to the slider 219 as it is. A rack gear 220 is fixedly secured to the slider 219 at the lower surface and engaged with a pinion gear 221 which is fixedly secured on the needle shaft 11 at the intermediate part. Consequently when the slider 219 is moved in its lateral direction, the needle shaft 11 makes its reciprocal rotational movement. The slider 219 is biased by a spring 222 so that the cam follower 216 is pressed against the side surface $S_1$ of the flange-like section $F_1$. Thus, when the cam follower 216 is guided by the shallow groove $214_a$ the cam follower 216 does not make its lateral movement, so that the needle shaft 11 does not rotate around its axis, thereby stopping the tack-in operation of the weft yarn end portion 5. When the cam follower 216 is guided by the deep groove 214*b*, the cam follower 216 is moved rightward and leftward under the action of the cam profile of the tack-in cam face 215*b*, so that the needle shaft 11 is reciprocally rotated around its axis thereby accomplishing a tack-in operation of the weft yarn end portion or portions.

Figure 12:
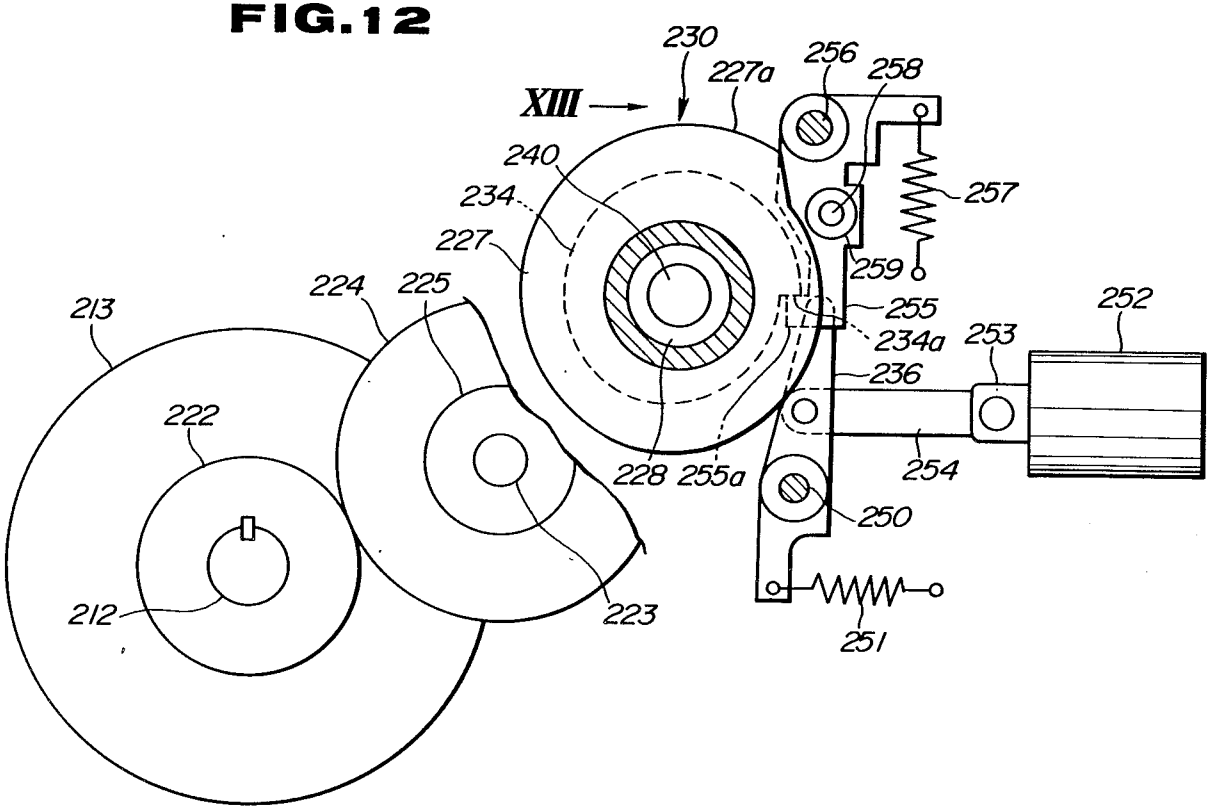
FIGS. 12 is a fragmentary front view of an essential part of a main body of the tack-in selvage forming apparatus of FIG. 12.
Figure 17:
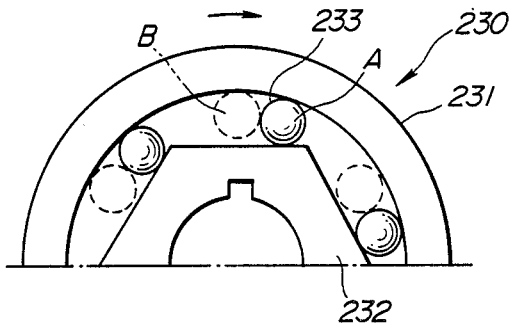
FIGS. 17 and 18 are fragmentary illustrations of an essential part of a clutch, used in the third embodiment tack-in selvage forming apparatus of FIG. 11.
Figure 18:
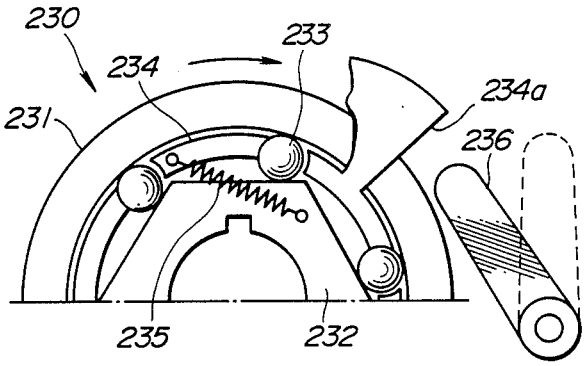

Subsequently, a discussion is made on a change-over mechanism for causing the cam follower 216 to be selectively brought into engagement with the shallow groove 214*a* (the resting cam face 215*a*) and the deep groove 214*b* (the tack-in cam face 215*b*). As shown in FIGS. 12 and 14, a gear 222 fixedly mounted on the drive shaft 212 is engaged with an intermediate gear 224 which is integrally and coaxially formed with another intermediate gear 225. The intermediate gear 225 is engaged with a gear 226 which is integral with a flange-like drive member 227 and rotatably mounted on a driven shaft 240 as a driven member. Thus, the drive member 227 is adapted to rotate at a speed of $\frac{1}{3}$ time of that of the loom main shaft. The rotation of the drive member 227 is transmitted to the driven shaft 240 through a clutch 230 as shown in FIGS. 17 and 18.

The clutch 230 includes a cylindrical outer ring 231 on the driving side and connected to the drive member 227, and a polygonal inner ring 232 on the driven side and connected to the driven shaft 240. A plurality of rollers 233 are disposed between the outer and inner rings 231, 232. When each roller 233 is in a position A, the outer and inner rings 231, 232 are firmly engaged with each other through the roller 233, so that power is transmitted from the outer ring 231 to the inner ring 232 thereby putting the clutch 230 into its engaging state. When the roller 233 is in a position B, the outer and inner rings 231, 232 are out of engagement, so that the outer ring 231 freely rotates thereby putting the clutch 230 into its disengaging state. Here, the rollers 233 are maintained by a trip cam cage 234, and the trip cam cage 234 and the inner ring 232 are connected with each other by a spring 235. Accordingly, the trip cam cage 234 is pulled in a rotational direction of the outer ring 231, thereby to thrust the roller 233 to establish the engaging state of the clutch 230. When a lever 236 as an engaging member is brought into engagement with a step section 234*a* of the trip cam cage 234 to stop the rotation of the trip cam cage 234, the roller 233 moves in the opposite direction of the rotation of the outer ring 231 thereby putting the clutch 230 into its disengaging state. In practice, the moment the lever 236 strikes against the step section 234*a*, the inner ring 232 slightly rotates under inertial force, thereby putting the clutch 230 into its disengaging state. Accordingly, by controlling the lever 236 to engage with or disengage from the trip cam cage step section 234*a* by means of an electromagnetic actuator and a pneumatically controlled actuator, rotational movement is transmitted from the driving side to the driven side, realizing clutch operation at a precise timing and stopping the rotational movement at a predetermined position. It will be understood that the drive member 227 is fixed to the outer ring 231, while the driven shaft 240 is fixed to the inner ring 232.

As shown in FIGS. 14 and 16, a disc-shaped grooved cam 241 is fixedly mounted on the driven shaft 240 and formed on its side surface with an outward groove 241*a* and an inward groove 241*b* which are connected with each other. The outward groove 241*a* is located radially outward of the inward groove 241*b*. Each groove 241*a*, 214*b* is arcuate and formed along the periphery of the grooved cam 241. The length of the inward groove 241*b* is about ⅓ of the total peripheral length of the outward and inward grooves 241*a*, 241*b*. A cam follower 244 rotatably supported at the end section of a lever 243 is put into and guided by the contiguous outward and inward grooves 241*a*, 241*b*. The lever 243 is integral with a cylindrical section (no numeral) rotatably mounted on a support shaft 242. Another lever 245 is integral with the cylindrical section and therefore moved together with the lever 243 as a single piece. A fork member 247 is pivotally supported at the tip end section of the lever 245 through a pin 246 as shown in FIGS. 15 and 16. A pin 248 is provided to bridge the bifurcated sections of the fork member 247. The rear end section of the rod 217 provided with the cam follower 216 is supported on the pin 248 in a manner to be slidably in the axial direction of the pin 48.

Accordingly, when the clutch 230 is engaged, the grooved cam 241 rotates one time per three rotations of the loom main shaft. During two rotations of the three rotations of the loom main shaft, the lever 243 is driven counterclockwise in FIG. 16 under the action of the outward groove 241, so that the cam follower 216 is located in the shallow groove 241*a*, thereby stopping the tack-in operation of the weft yarn end portion 5. During the succeeding one rotation of the loom main shaft, the lever 243 is driven clockwise in FIG. 16 under the action of the inward groove 241*b*, so that the cam follower 216 is located in the deep groove 215, thereby accomplishing the tack-in operation of the weft yarn end portion 5. Such an operation manner is used to intermittently carry out a tack-in operation in which three weft yarn end portions 5 are together tacked in at the same time, in order to weave the pile section of the fabric.

When the clutch 230 is disengaged, the rotation of the grooved cam 241 is stopped in which the cam follower 244 is stopped in a state to be guided by the inward groove 241*b*. Consequently, the lever 243 continues to be driven clockwise in FIG. 16, so that the cam follower 216 is located in the deep groove 214*b* thereby accomplishing the tack-in operation of the weft yarn end portion 5. Such an operation manner is used to carry out a tack-in operation in every weaving cycle of the loom in which each weft yarn portion 5 is tacked in, in order to weave the border section of the fabric. As discussed above, the intermittent tack-in operation and the every time tack-in operation are controllably changed under the change-over operation of the clutch 230.

Figure 13:
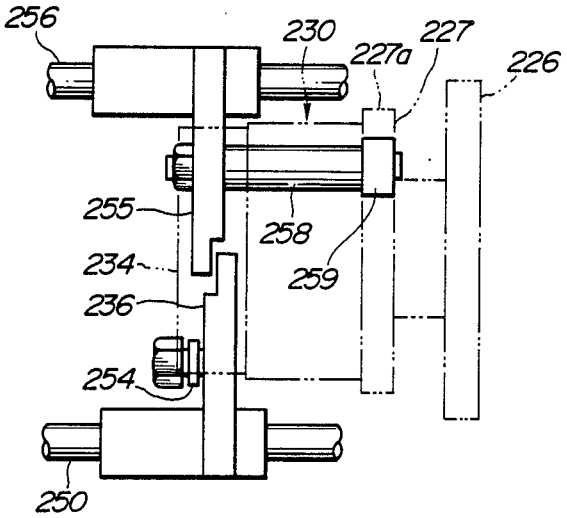
FIG. 13 is a fragmentary view as viewed from the direction of an arrow XIII of FIG. 12.

Next a discussion will be made on a change-over mechanism of the clutch 230 with reference to FIGS. 12 to 14. The change-over mechanism includes the lever 236 which is adapted to be brought into engagement with or disengagement from the step section 234*a* of the trip cam cage 234. This lever 236 is rotatable around a support shaft 250 and biased by a spring 251 to rotate counterclockwise in FIG. 12 so as to be put into an engaging position to be brought into engagement with the step section 234*a* of the trip cam cage 234. The lever 236 is connected through a connecting rod 254 to a power output rod 253 of an electromagnetic actuator 252, in which the lever 236 is put from the engaging position into a disengaging position to bring the lever 236 into disengagement from the trip cam cage step section 234*a* when the electromagnetic actuator is energized.

Additionally, a lever 255 is adapted to be put into its engagement position to be brought into engagement with the step section 234*a* of the trip cam cage 234 and into its disengagement position to be brought into disengagement from the step section 234*a*. The lever 255 is rotatable around a support shaft 256 and biased clockwise in FIG. 12 by a spring 257. A cam follower 259 is rotatably supported through a pin 258 and is in contact with a cam 227*a* formed on the peripheral surface of the drive member 227. Under the action of the cam 227*a*, a pawl section 255*a* of the lever 255 is brought into an engaging position to be engaged with the trip cam cage step section 234*a* before a predetermined clutch engagement timing, and brought into a disengaging position to be disengaged from the step section 234*a* at a predetermined clutch disengagement timing.

Accordingly, in order to change the clutch 230 from its engaging state to its disengaging state, the electromagnetic actuator is deenergized before the predetermined clutch disengagement timing. Then, the lever 236 is brought into the engaging position to be engageable with the trip cam cage step section 234*a* under the biasing force of the spring 251. Under this state, when the trip cam cage 234 rotates and its step section 234*a* reaches a position to engage with the lever 236, the rotation of the trip cam cage 234 is stopped, thereby causing the clutch 230 to be disengaged. Thus, tack-in operation is changed to a manner in which a tack-in operation is made in every weaving cycle.

In order to change the clutch 230 from its disengaging state to its engaging state, the electromagnetic actuator 252 is energized before the predetermined clutch engaging timing, thereby to bring the lever 236 into the disengaging position to be disengaged from the trip cam cage step section 234*a*. At this time, since the pawl section 255*a* of the lever 255 is in the engaging position to be disengaged with the trip cam step section 234*a*, the clutch 230 cannot be engaged before the predetermined clutch engaging timing even if the lever 236 gets out of the trip cam cage step section 234*a* under energization of the electromagnetic actuator 252. When the predetermined clutch engaging timing has been reached, the lever 255 is disengaged from the trip cam cage step section 34*a* under the action of the cam 227*a* and therefore the rotation of the trip cam cage 234 begins, thus engaging the clutch 230. Accordingly, a precise clutch engaging timing can be obtained without being affected by response retardation of the electromagnetic actuator 252 and the like.

FIGS. 19 to 22 illustrates a fourth embodiment of the tack-in selvage forming apparatus 1 in accordance with the present invention, which is similar to the first to third embodiments except for the construction of a needle holder 309 for holding the tack-in needle 2. In this embodiment, the tack-in needle 2 is formed of a relatively hard material such as iron or stainless steel and fixed to the tip end section of the needle holder 309 with a small screw 366. The base end section of the needle holder 309 is mounted on the needle shaft 11 and fixed in position by a bolt 365. The needle shaft 11 projects rearwardly from the main body 10 of the tack-in selvage forming apparatus 1 and arranged to make its reciprocal movement in the axial direction and its reciprocal rotational movement around its axis. The tack-in needle 2 is totally curved and formed at its tip end part with a hook section 2*a* which functions to catch the weft yarn end portion (5) and turn it up so that the weft yarn end portion is pulled into the next warp yarn shed.

Here, the needle holder 309 is formed of a brittle material such as aluminum casting (aluminum alloy casting) in order that the needle holder 309 can be broken if struck against the reed 8 or the like. Additionally, a notch 309*a* is formed on the surface of the needle holder 309. Under the effect of the notch 309*a*, the needle holder 309 become more brittle and can be broken at a predetermined position. Furthermore, a stiff wire 371 such as a piano wire or a wire of FRP (fiber reinforced metal) is embedded in the brittle needle holder 309. Accordingly, even if the needle holder 309 is broken upon being struck against the reed 2, the upper and lower broken pieces are connected with each other through the wire 371, thereby preventing the broken piece of the needle holder 309 from being thrown away.

Figure 22:
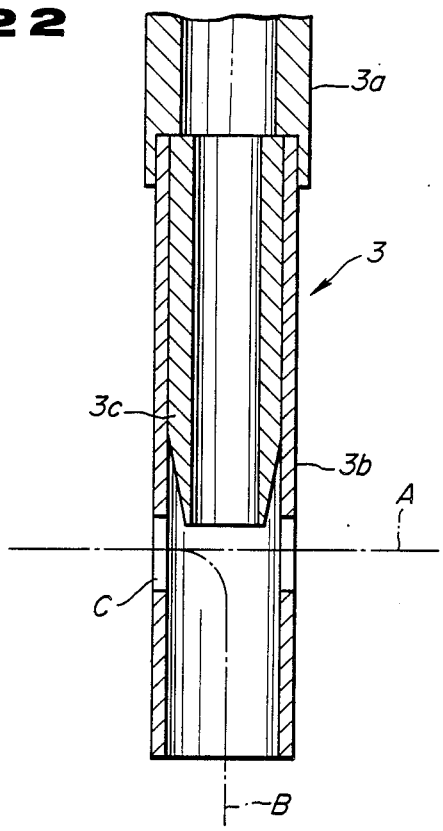
FIG. 22 is a longitudinal sectional view of a weft yarn end retaining device used in the tack-in selvage forming apparatus of FIG. 19.

A cutter 4 of the scissors type is provided to cut the end portion of the picked weft yarn and includes a fixed blade 4*a* and a movable blade 4*b*.The weft yarn end portion retaining device 3 of the air nozzle type is provided to retain the picked weft yarn end portion in a tensioned state. The weft yarn end retaining device 3 includes a L-shaped hollow member 3*a* which is attached to the main body 10 through a bracket 314 and supplied with pressurized air from a pressurized air supply pipe 315. A pipe 3*b* is projected downwardly from the tip section of the hollow member 3*a* to be supplied with the pressurized air from the hollow member 3*a*. The pipe 3*b* is formed at rear side peripheral surface with a cutout C. The cutout C is located between the selvage structure of the fabric and the cutter 4 and on a warp line (extending parallel with warp yarns) rearward of the cloth fell F of a woven fabric 304. As shown in FIG. 22, an air ejection nozzle 3*c* is disposed within the pipe 3*b* and located upward of the cutout C. A weft guide 319 is disposed by the cutter 4 and located on the counter-selvage side relative to the cutter 4. The weft guide 319 has an inclined guide section 319*a* and an engaging groove section 319*b*, so that the weft yarn is engaged with the engaging groove section 329*b* during beating-up operation, thereby to be located within the open mouth of the cutter 4 and the cutout C through which air stream passes. A guide lever 320 is rotatably mounted on a fixed shaft 321 projects from the main body 10 and has a tip end section which is swingable in such a manner as to press the weft yarn toward the tack-in needle 2 when the weft yarn end portion is transferred from the weft yarn end portion retaining device 3 to the tack-in needle 2 within a place between the selvage structure and the retaining device 3.

The operation of a selvage formation by the fourth embodiment tack-in selvage forming apparatus will be discussed herein after.

After the weft yarn is picked, when a beating-up operation is made upon advancing of the reed 8, the weft yarn is moved along the inclined guide section 319*a* and enters the engaging groove section 319*b* to be engaged, so that the weft yarn end portion is kept in this position even upon backward movement of the reed 8. In this position, the weft yarn end portion extended between the selvage structure and the weft guide 319 is located within the open mouth of the cutter 4 and also located within the cutout C of the pipe 3*b* of the weft yarn end portion retaining device 3 as indicated by a line A in FIG. 22. It will be understood that the reed blades of the reed 8 are omitted in parts corresponding to the cutter 4, the weft yarn end portion retaining device 3, the weft guide 319 and the guide lever 320.

Here, assuming that the beating-up operation is made at a loom main shaft rotational angle of 0 degrees, the movable blade 4*b* of the cutter 4 is driven at a loom main shaft rotational angle of about 5 degrees through a cutter lever 358 provided with a cam follower 359 by a cam 354, thus cutting the weft yarn end portion under cooperation with the fixed blade 4*a*.

At this time, the weft yarn end portion between the selvage structure and the cutter 4 has been already located within the cutout C in which air stream is formed. Accordingly, when the weft yarn end portion is cut by the cutter 4, the weft yarn end portion at the selvage structure side is sucked into the pipe 3*b* through the cutout C under the influence of air stream from the air ejection nozzle 3*c* and of suction air stream generated around the cutout C. Thus the weft yarn end portion is drawn and kept in position as indicated by a line B in FIG. 22. Such a kept condition of the weft yarn end portion is maintained until the weft yarn end portion is transferred to the tack-in needle 2, in which the weft yarn end portion is being drawn by air stream and therefore is not slackened.

Figure 20:
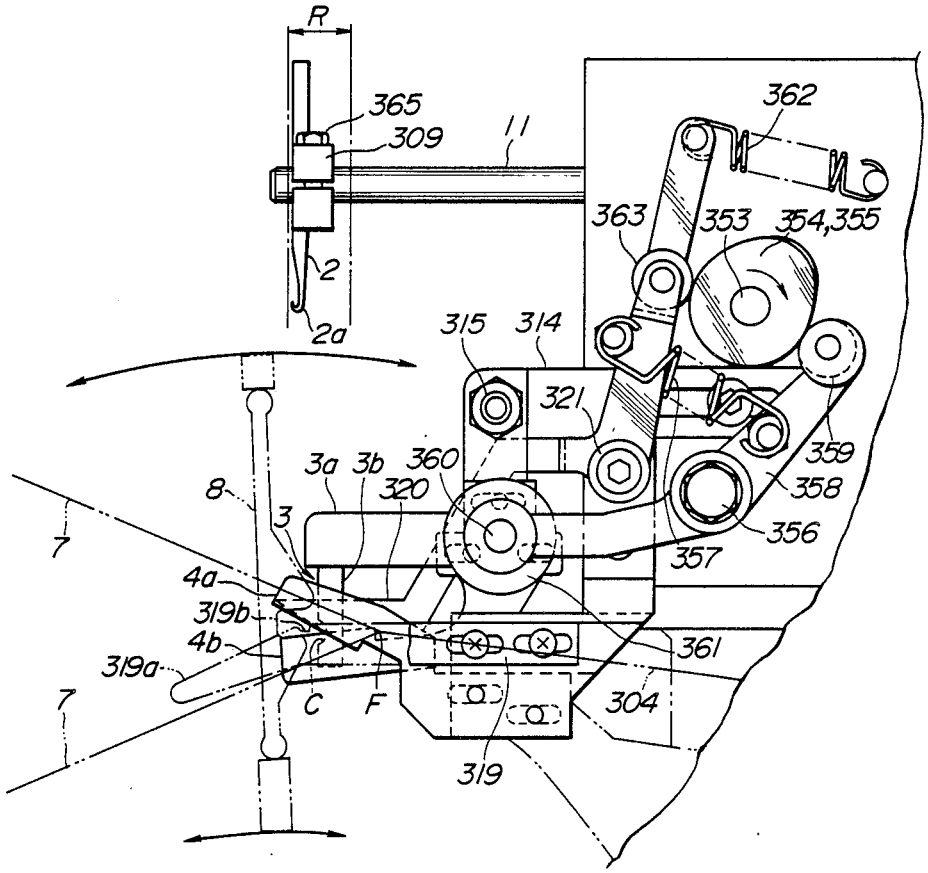
FIG. 20 is a fragmentary side view of an essential part of the tack-in selvage forming apparatus of FIG. 19.
Figure 21:
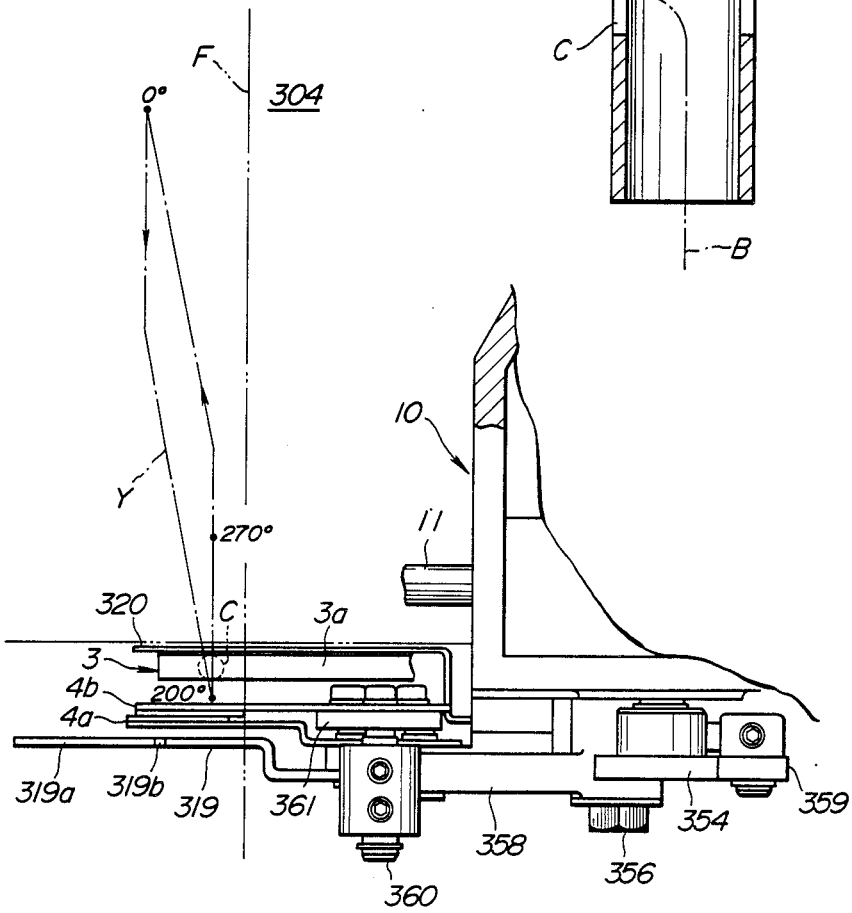
FIG. 21 is a fragmentary plan view of the essential part of FIG. 20.

Subsequently, the next weft yarn is successively introduced into a beating-up step from a loom main shaft rotational angle of about 90 degrees, in which the hook section 2*a* of the tack-in needle 2 is moved along a reciprocal rotational movement locus Y indicated by a dot-dash line in FIGS. 19 and 21 and within a fore-and-aft direction movement range R indicated in FIG. 20. Within a loom main shaft rotational angle ranges from 0 degrees to 200 degrees, the tack-in needle hook section 2*a* gradually swings downward from the upward side of the warp yarn array to approach the cloth fell F. During this movement of the tack-in needle hook section a, the tack-in needle hook section 2*a* is inserted through the upper side of the warp yarn array into the warp yarn shed opening. Subsequently, the tack-in needle hook section 2*a* gets out of the warp yarn array and passes under the weft yarn end portion extending between the selvage structure and the weft yarn end portion retaining device 3 in a manner to obliquely cross the weft yarn end portion. Finally the tack-in needle hook section 2*a* reaches a position slightly upward of the warp line as shown in 19.

From a loom main shaft rotational angle of 200 degrees, the tack-in needle 2 begins to swing in the opposite direction. At this time, the guide lever 320 is swung counterclockwise in FIG. 20 under the action of a cam 355, so that the weft yarn end portion extended between the selvage structure and the weft yarn end retaining device 3 is pressed toward the tack-in needle 2. As a result, when the tack-in needle 2 swings in the opposite direction, the weft yarn end portion is securely caught by the tack-in needle hook section 2*a*. Under such a condition in which the weft yarn end portion is caught, the hook section 2*a* of the tack-in needle 2 moves back to the warp yarn shed opening and accordingly the weft yarn end portion is turned up and inserted into the next warp yarn shed opening in the reverse phase relative to an already woven part as the fabric 304.

At a loom main shaft operational angle of about 270 degrees, the tack-in needle 2 gets out of the warp yarn shed opening passing through the upper side of the warp yarn array,.and then gets out of the beating-up course of the reed 8. When the picked weft yarn is beaten upon advancing of the reed 8, the weft yarn end portion which has been turned up at the selvage structure and inserted into the warp yarn array is simultaneously beaten up thereby to form the selvage structure.

Here, assuming that the tack-in needle 2 strikes against the reed 8 when the movement of the tack-in needle 2 becomes out of order due to loosening of the needle holder 309, disorder of timing of the driving mechanism and the like, the needle holder 309 is immediately broken at the part of the notch 309*a* because of formed of the brittle material and existence of the knotch 309. Accordingly, only a slight damage is made in the reed 8 and therefore the reed 8 is restored to its original state by a simple repairing. Although the needle holder 309 is broken at the part of the notch 309*a*, the broken pieces are connected with each other by the strong wire 371 embedded in the needle holder 309 throughout an almost whole length. Accordingly, the tack-in needle 2 at the side of one of the broken pieces is prevented from being thrown away, thus securing safe operation of the loom. It is to be noted that, in this embodiment, the wire 371 having a stiffness is embedded in one-sided as shown in FIG. 19, and therefore the direction in which the needle holder 2 breaks can be previously set to a safe direction.

Figure 19:
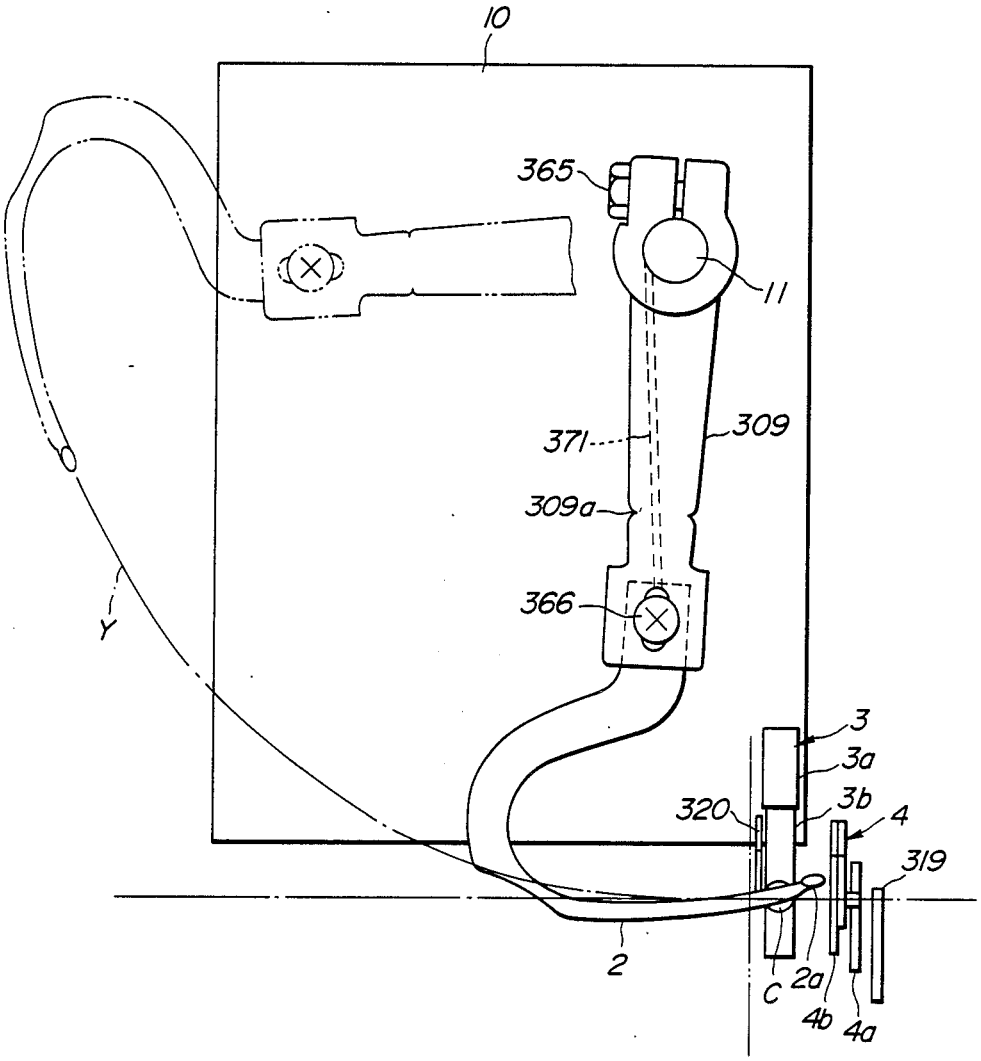
FIG. 19 is a front view of a fourth embodiment of the tack-in selvage forming apparatus in accordance with the present invention.
Figure 23:
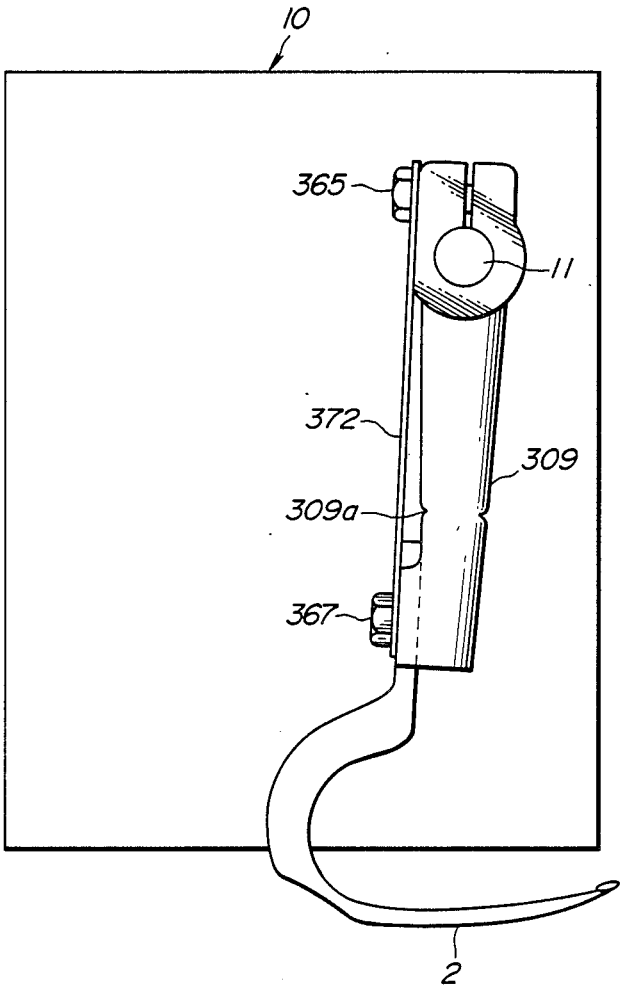
FIG. 23 is a front view similar to FIG. 19 but showing a modified example of an arrangement including a tack-in needle of the fourth embodiment selvage of the forming apparatus.
Figure 24:
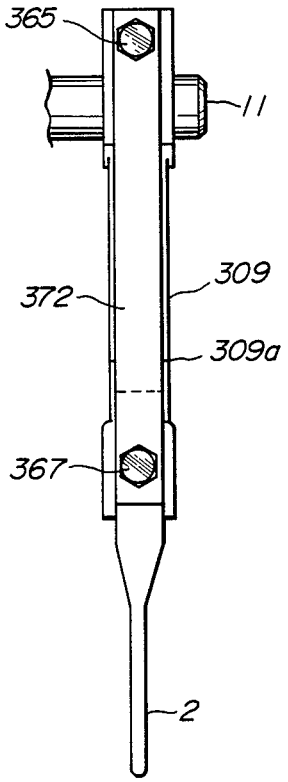
FIG. 24 is a fragmentary side view of an essential part of the arrangement of FIG. 23.

FIGS. 23 and 24 show an example of a needle holder 309 which is similar to that in FIGS. 19 and formed of a brittle material such as aluminum (alloy) casting and formed with a notch 309*a*. The needle holder 309 of this example is provided with a plate spring 372 which is disposed along the length of the needle holder 309 and fastened to the needle holder 309 with the bolt 365 for fastening the needle holder 309 onto the needle shaft 11 and with the bolt 367 for fastening the tack-in needle 2 to the needle holder 309. With this arrangement, even if the needle holder 309 is broken upon striking against the reed, the broken pieces are connected with each other through the plate spring 372, so that the tack-in needle 2 is prevented from being thrown away.

Figure 25:
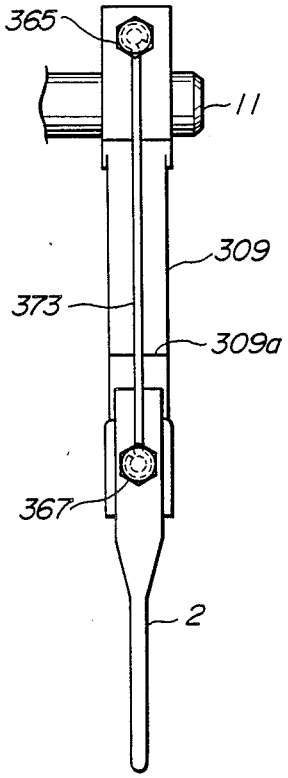
FIG. 25 is a fragmentary side view similar to FIG. 24 but showing another modified example of the arrangement of FIG. 23.

FIG. 25 shows another example of the needle holder 309 which is similar to that of FIGS. 23 and 24 with the exception that a wire 373 such as a piano wire is disposed along the length of the needle holder 309. The wire 373 is provided at its opposite ends with hook sections which are fastened to the needle holder 309 with the bolts 365, 367, respectively. Accordingly, even when the tack-in needle 2 strikes against the reed and the needle holder 309 is broken, the broken pieces are connected with each other through the wire 373 having a stiffness and therefore the tack-in needle 2 is prevented from being thrown away.

Figure 26A:
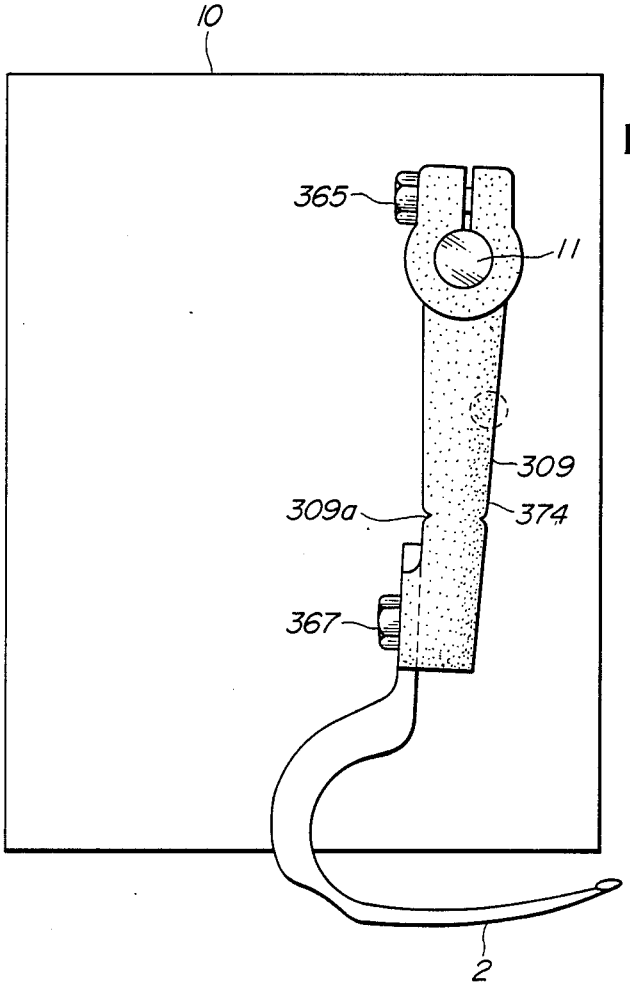
FIG. 26 is a fragmentary side view similar to FIG. 24 but showing a further modified example of the arrangement of FIG. 23.
Figure 26B:
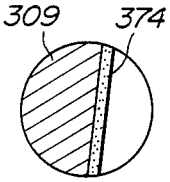

FIG. 26 shows a further example of the needle holder 309 which is similar to that in FIG. 10 with the exception that no wire is embedded in the needle holder 309. In this embodiment, rubber material 374 having a stiffness is coated on the surface of the needle holder 309. Accordingly, even when the tack-in needle 2 strikes against the reed and the needle holder 309 is broken, the broken pieces are connected with each other through the rubber material, thus preventing the tack-in needle 2 from being thrown away.

In the examples of FIG. 23 to 26, the material having a stiffness is arranged to be installed outside of the needle holder 309 and therefore the needle holders of these examples are easily produced as compared with the needle holder having the stiff material embedded in the needle holder.

While the needle holder 309 has been shown and described as being formed of a brittle material, it will be understood that at least a part of a swingable body including the needle holder 309 and the tack-in needle 2 may be formed of a brittle material. Accordingly, at least a part of the tack-in needle 2 may be formed of a brittle material, in which a material having a stiffness is installed to bridge over the brittle material. In order to make brittle at least a part of the swingable body including the needle holder 309 and the tack-in needle 2, the corresponding part may be formed of a brittle material such as aluminum (alloy) casting; a structurally brittle part such as a part having a notch is provided; or a combination of these is employed.

What is claimed is:

1. A tack-in selvage forming apparatus for a loom, comprising:

a tack-in needle selectively taking first and second operating status;

a cylindrical grooved cam rotatable in timed relation to a main shaft of the loom and including means for defining first and second cam grooves formed along the periphery of said grooved cam, said first cam groove being parallel with a plane perpendicular to axis of said grooved cam, said second cam groove being curved relative to said plane, at least a part of said second cam grooves being deeper than said first cam groove, a part of said first cam groove and a part of said second cam groove being common,.said first cam groove having a profile corresponding to the first operating state of the tack-in needle, said second cam groove having a profile corresponding to the second operating state of the tack-in needle;

a cam follower drivingly connected to said tack-in needle;

means for selectively putting said cam follower into said first and second cam grooves; and means for putting said tack-in needle into the first and second operating states when said cam follower is put in said first and second cam grooves, respectively.

2. A tack-in selvage forming apparatus as claimed in claim 1, wherein said means for selectively putting includes means for controlling a amount of movement of said cam follower in a radially inward direction of said groove can in accordance with a predetermined program.

3. A tack-in selvage forming apparatus as claimed in claim 2, further comprising means for converting movement of said cam follower in the axial direction of said grooved cam into reciprocal rotational movement of said tack-in needle.

4. A tack-in selvage forming apparatus as claimed in claim 2, wherein said means for controlling an amount of movement includes an auxiliary grooved can rotatable in timed relation to the loom main shaft, said can follower being driven in accordance with a cam groove formed in said auxiliary grooved cam.

5. A tack-in selvage forming apparatus as claimed in claim 4, wherein said movement amount controlling means includes a cam face defining said second cam groove, said cam face having a profile causing said cam follower to move in the radial direction of said cylindrical groove cam.

6. A tack-in selvage forming apparatus as claimed in claim 4, further comprising a clutch interposed between a drive member which is driven i timed relation to the loom main shaft, and a driven member connected to said auxiliary grooved cam, said clutch being adapted to engage to establish a driving connection between said drive member and said driven member and to disengage to interrupt the mechanical connection.

7. A tack-in selvage forming apparatus as claimed in claim 6, wherein said clutch includes a trip cam cage having a trip cam cage step section adapted to rotate to disengage said clutch and to stop in rotation to engage said clutch.

8. A tack-in selvage forming apparatus as claimed in claim 6, further comprising a first engaging member adapted to be disengageable from said trip cam cage step section to allow said trip cam cage to rotate, said first engaging member being driven by an electromagnetically operated actuator in a manner to disengage from said trip cam cage step section at a first timing earlier than a predetermined clutch engaging timing, and a second engaging member adapted to be engageable and disengageable with said trip cam cage step section to allow said trip cam cage to rotate and to stop rotation of said trip cam cage, said second engaging member being driven by a cam rotating with said drive member, in a manner to engage with said trip cam cage step section at a second timing before,,said predetermined clutch engaging timing and to disengage from said trip cam cage step section at said predetermined clutch engaging timing.

9. A tack-in selvage forming apparatus as claimed in claim 2, wherein said tack-in needle forms part of a swingable body which is securely mounted on a needle shaft through which said tack-in needle is mechanically connected with said cam follower, at least a part of said swingable body being made of a material more brittle than another part of said swingable body so as to allow said swingable body to be broken upon striking against a rigid member, said swingable body including an elongate rigid member which is stiffer than said at least a part of said swingable body, said elongate rigid member being securely connected with said other part of said swingable body so as to connect broken pieces of said swingable body even when said swingable body is broken into the broken pieces.

10. A tack-in selvage forming apparatus as claimed in claim 1, wherein said second cam groove profile is arranged to cause said cam follower to move in the axial direction of said grooved cam, said axial movement of said cam follower causing a movement of the track-in needle in the second operating state.

11. A tack-in selvage forming apparatus as claimed in claim 1, wherein said first operating state is a state in which a tack-in operation is stopped, and said second operating state is a state in which a tack-in operation is carried out.

12. A tack-in selvage forming apparatus as claimed in claim 1, wherein each of said first and second cam grooves is generally annular and extends along the periphery of said grooved cam.

* * * * *